United States Patent [19]

Petersen, Jr.

[11] Patent Number: 4,538,740

[45] Date of Patent: Sep. 3, 1985

[54] TAMPER RESISTANT CLOSURE

[75] Inventor: Benjamin R. Petersen, Jr., Wheaton, Ill.

[73] Assignee: Fantasy Flavors, Inc., Wheaton, Ill.

[21] Appl. No.: 565,976

[22] Filed: Dec. 27, 1983

[51] Int. Cl.[3] ..... B65D 49/12

[52] U.S. Cl. ..... 215/246; 215/252; 215/256; 215/258

[58] Field of Search ..... 215/246, 252, 256, 258

[56] References Cited

U.S. PATENT DOCUMENTS

| | | | |
|---|---|---|---|
| 2,223,017 | 11/1940 | Abrams et al. | 226/80 |
| 2,758,735 | 8/1956 | Carter | 215/38 |
| 2,790,286 | 4/1957 | Snyder | 53/41 |
| 2,954,139 | 9/1960 | Owens | 215/38 |
| 3,158,278 | 11/1964 | Knapp et al. | 215/42 |
| 3,189,208 | 6/1965 | Jowett | 215/38 |
| 3,199,703 | 8/1965 | Alexander | 215/42 |
| 3,672,528 | 6/1972 | Faulstich | 215/46 |
| 3,746,201 | 7/1973 | Fujio | 215/246 |
| 3,844,861 | 10/1974 | Irish, Jr. | 215/246 X |
| 3,924,771 | 12/1975 | Cleff | 215/246 |
| 3,929,246 | 12/1975 | Leitz | 215/252 |
| 3,951,292 | 4/1976 | Amberg | 215/230 |
| 4,153,174 | 5/1979 | Keeler | 215/252 |
| 4,206,851 | 6/1980 | Ostrowsky | 215/246 |
| 4,278,180 | 7/1981 | Willis | 215/252 |
| 4,333,577 | 6/1982 | Mumford | 215/246 |
| 4,436,212 | 3/1984 | Llera | 215/252 |

*Primary Examiner*—Steven M. Pollard

*Attorney, Agent, or Firm*—Willian Brinks Olds Hofer Gilson & Lione Ltd.

[57] ABSTRACT

A tamper resistant closure for screw top and other containers is provided which resists and visibly discloses attempted tampering. A heat shrinkable plastic sleeve including at least one row of longitudinal mechanical weakness, such as a line of perforations, snuggly surrounds both the screw cap and a portion of the neck of the associated container. Sharp protruding teeth integral to the covered portion of the container neck interfere with the longitudinal weak areas when the shrunk sleeving is forcibly rotated during an attempted tampering, causing a portion of the plastic material to rupture and indicating tampering. By providing a second row of longitudinal weakness, such as a second closely spaced parallel line of perforations, a tear-away portion results whereby the features which provide indication of tampering also provide a convenient means for desired removal of the protective sleeve by the intended user.

20 Claims, 8 Drawing Figures

TAMPER RESISTANT CLOSURE

FIELD OF THE INVENTION

This invention relates generally to closure systems for containers and the like and more particularly to closures and containers which provide evidence of tampering and which are tamper resistant.

BACKGROUND OF THE INVENTION

In the past, persons in the art have recognized the need to provide tamper resistant closures for medicine and food containers. For example, Knapp, U.S. Pat. No. 3,158,278, discloses one form of tamper resistant closure. In Knapp's system, a metal cap having a two part skirt connected by bridges is placed on a container having a plurality of longitudinal ridges spaced along the neck, and axial threading positioned thereabove. The cap is crimped onto the closure, so that it conforms to the threading and the ridges. When twisting forces are applied to open the cap, the ridges prevent the lower part of the skirt from rotating. The twisting forces eventually cause the bridges to break, providing evidence of tampering.

A similar system is disclosed by Keeler, U.S. Pat. No. 4,153,174. A molded plastic cap having an upper skirt featuring threading is connected to a lower skirt having at least one U-shaped break-away tab molded therein. The tab engages the lower edge of a tamper molded on the container beneath the threading. When the cap is twisted, the break-away tab presses against the ring and, as the forces increase, breaks away, providing evidence of tampering.

In another system disclosed by Amberg, U.S. Pat. No. 3,951,292, a bottle having a long neck is provided with a conventional bottle cap. A framed thermoplastic overcap is provided having a plurality of longitudinal pleats and an axial scoring line placed such that it aligns with the space defined by the end of the cap and the beginning of a lip provided on the bottle neck. The overcap is glued in place using an adhesive and is torn along the score line when the bottle cap is twisted open. The broken overcap provides evidence of tampering.

Each of the foregoing systems, however, has attendant disadvantages. The Knapp systems requires special machinery to crimp the metal caps in place, which is expensive and not entirely suitable for all types of containers. Moreover, the required metal caps themselves are much more expensive than molded plastic caps, and are less adaptable to special features such as pouring spouts. Finally, such metal caps may have, after opening, exposed sharp edges, a possible accident hazard.

The Keeler system uses a breakway mechanism which could possibly slip over the threading on the bottleneck, thereby defeating the tamper evident mechanism. The Amberg system seems adapted especially for use in glass bottles having long necks, and seems illsuited for use in wide-mouth containers having very short necks.

Finally, each the foregoing existing closure systems require a fair amount of force to open, and would therefore be difficult for an elderly or arthritic person or a young child to easily operate.

Accordingly, it is an object of the present invention to provide a tamper resistant closure which is useful with a wide variety of containers, closures, and materials. It is also an object of the invention to provide a tamper resistant closure which may be easily opened by cutting or peeling away a protective sleeve.

It is another object of the invention to provide a tamper resistant closure using inexpensive materials which can be easily and economically manufactured. It is yet another object of the invention to provide a tamper resistant closure which consistently provides obvious evidence of tampering, and which cannot easily be defeated.

Another object is to provide a bottle including projecting teeth engaging a shrinkable sleeve wherein the cooperation of the shrunk sleeving and the projecting teeth provides tamper resistance. A further object is to provide such a bottle and sleeve wherein the interaction between the teeth and the sleeve when the sleeve is forcibly rotated relative to the teeth during tampering, irreversibly and visibly affects the sleeve, indicating tampering.

A further object is to provide a shrink wrap sleeve which has longitudinal areas of relative mechanical weakness. A related object is to provide a bottle with projecting teeth wherein the longitudinal weak areas cooperate with the teeth during tampering, resulting in mechanical failure and tearing of the sleeve proximate to the teeth, thereby providing an indicator of tampering. A still further object is to provide a tamper resistant closure system in which such longitudinal areas of weakness also function to provide a tear-away tab portion for easy removal of the protective sleeve.

These and other advantages, objects, and features at the present invention will become apparent in light of the present specification and accompanying drawings.

SUMMARY OF THE INVENTION

The disadvantages of previous systems are largely overcome and the objects of the present invention are attained by providing a tamper resistant closure which includes a container having a mouth, a neck, and at least one rigid spine or tooth protruding axially from the container adjacent to the neck. The container is fitted with a cap which may screw on to cover and seal the mouth. Fitted over the cap and engaging the tooth disposed adjacent to the neck is a thermoplastic sleeve. Preferably, the engagement between the container and the sleeve is attained by shrinking the sleeve tightly around the cap and the teeth so that the teeth protrude and stretch the sleeve. In this way, when the cap and sleeve are twisted in an opening direction, the twisting forces will be resisted by the teeth, which may stretch or pierce the sleeve in response to the resulting strain and stress and thereby provide evidence of tampering.

Superior operation is achieved by further providing areas of longitudinal mechanical weakness in the thermoplastic sleeve, designed to fail mechanically prior to the bulk of the sleeve in response to the applied force and strain caused by the protruding teeth as described. These areas, which may be provided by lines of perforations in the sleeve or by score lines of reduced thickness, will fail upon encountering the protruding teeth to indicate tampering.

Finally, by providing two or more such lines of mechanical weakness such as perforations and a finger grip tab in between, a tear-away portion results which the purchaser may easily remove by applying force to the tab to overstress the weakened areas, thereby removing the sleeve to permit use of the container contents.

DETAILED DESCRIPTION OF THE PRESENTLY PREFERRED EMBODIMENTS

Other features, advantages, and objects of the invention will best be understood by reference to the following detailed description taken in conjunction with the accompanying drawings.

Figure 1:
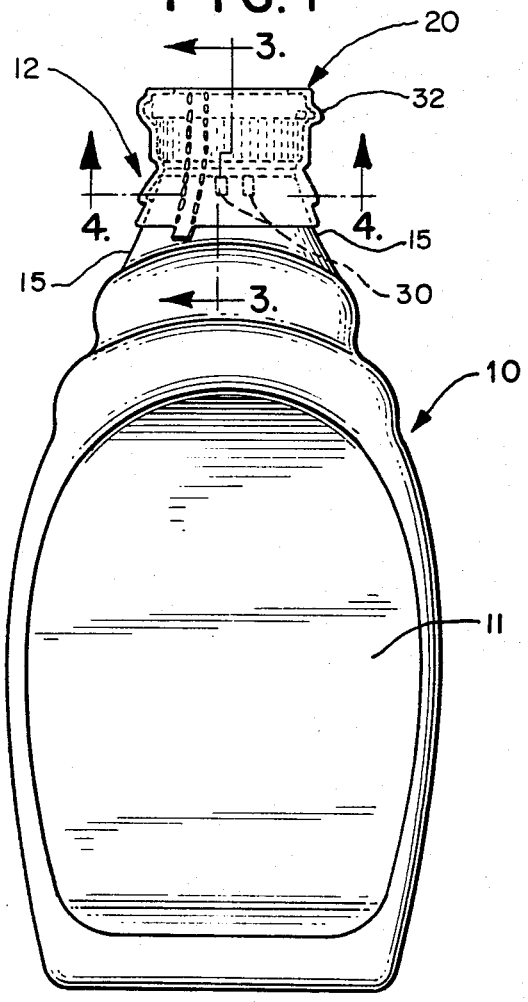
FIG. 1 is a perspective view of the presently preferred embodiment of the tamper resistant closure system of the present invention.

FIG. 1 illustrates a container 10 including the tamper resistant closure of the present invention. The container 10 includes a hollow body 11, a neck portion 12, and shoulders 15. The neck portion 12 is further illustrated and discussed in connection with FIG. 2, below.

Shown in phantom in FIG. 1 are protruding teeth 30 integral to neck portion 15 of container 10, and screw cap 20 shown in sealing engagement with container 10, as further described and discussed in connection with FIGS. 2 and 3, below. Finally, shrunk plastic collar 32 is shown in shrunken relationship to cap 20 and to neck portion 15 including protruding teeth 30.

The hollow body 11 of container 10 is preferably suitable for containing edible solid, semi-solid, or liquid foods or medicines. The shape of the body 11 of container 10 is a matter of design preference, and may in one preferred embodiment comprise the shape as disclosed in U.S. Pat. No. De. 266,402 which is hereby incorporated by reference. Preferably, body 11 of container 10 presents sufficient surface area for necessary or desirable labeling and description of the enclosed products.

Figure 2:
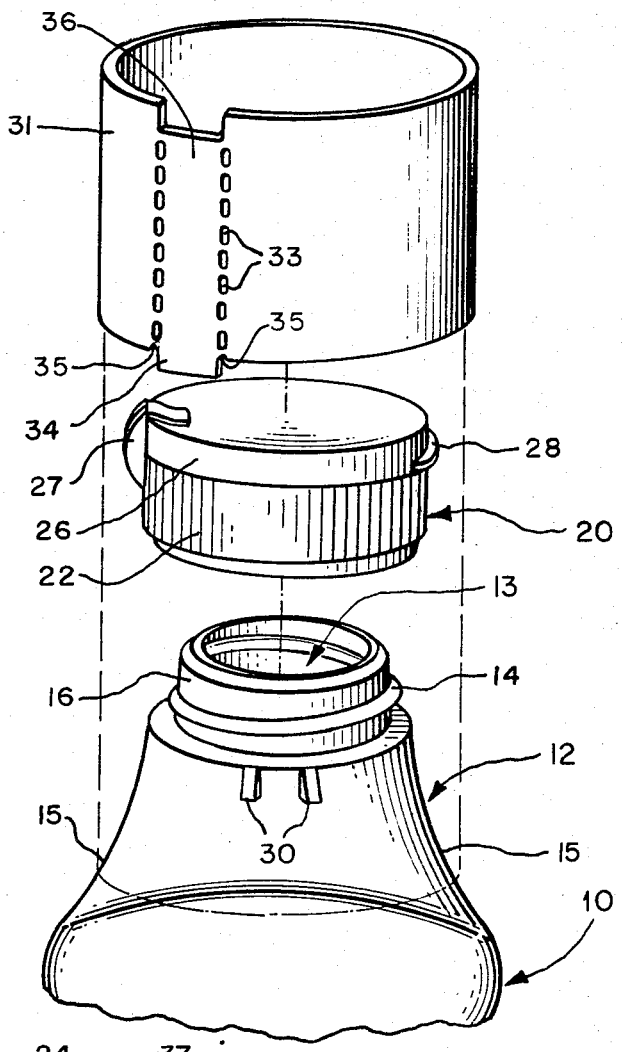
FIG. 2 is an exploded perspective view of the preferred embodiment, with the container partially cut away.

As illustrated in FIG. 2, neck portion 12 of container 10 further includes means for attaching a closure cap to seal container 10 and protect its contents. In the preferred embodiment illustrated, such sealing is accomplished by providing screwable cap 20 cooperating with cylindrical collar 16 which extends from neck 15 of container 10. The collar 16 preferably has spiral male threading 14 molded thereon to provide means for screwably and securely attaching the cap 20. Finally, the upper surface of cylindrical collar 16 defines an aperture or mouth 13 which provides access to the interior cavity of the body 11 of container 10, for filling and for removing the contents of container 10.

Figure 3:
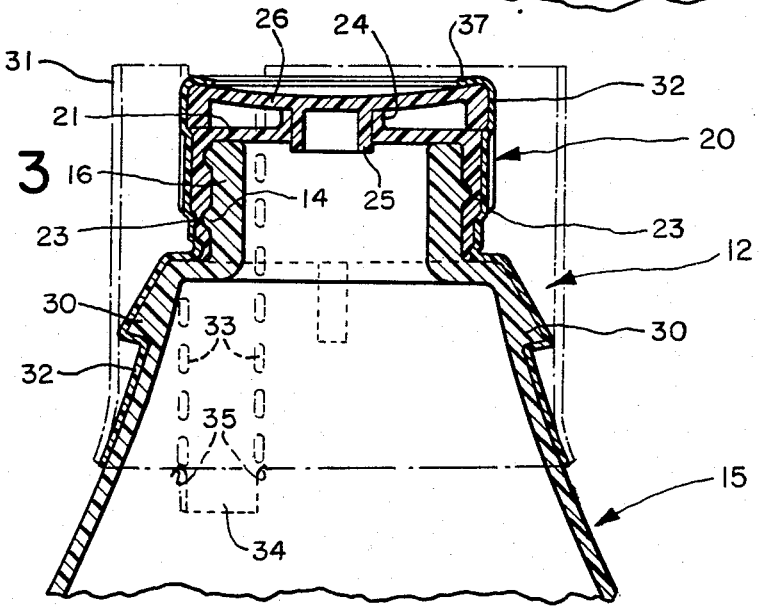
FIG. 3 is a sectional view of the embodiment of FIG. 1 taken along line 3—3 thereof.

Screwable cap 20 includes generally an annular skirt 22 descending from a disk-shaped top portion 21, as illustrated in cross section in FIG. 3. Female cap threading 23 in the interior surface of annular skirt 22 cooperates with the male threading 14 of the cylindrical collar 16 in a manner known in the art to permit secure attachment of screwable cap 20 to container 10. In a preferred embodiment of screwable cap 20 illustrated in FIGS. 2 and 3, a flip-top pour spout is provided for convenient and controlled dispensing of the contents of container 10. Specifically, an aperture surrounded by pouring spout 24 is provide in the disk-shaped top portion 21 of cap 20.

The preferred embodiment of cap 20 further includes spout sealer 25, attached to flip-top 26 of cap 20, for sealing the aperture defined by pour spout 24. Flip-top 26 comprises a substantially disc shaped member attached to annular skirt 22 by hinge means 27, and operated by finger grip 28. Spout sealer 25 comprises a downward protruding sleeve whose outer diameter is substantially equal to the inner diameter of the aperture defined by pour spout 24, such that the outer surface of spout sealer 25 snuggly and sealably engages the inner surface of pouring spout 24 in manners known in the art when the flip-top 26 is in a closed position.

Also illustrated in FIG. 2 is a preferred embodiment for shrinkable plastic sleeve 31, which comprises a substantially cylindrical portion of a heat shrinkable plastic material known in the art. The shrinkable plastic sleeve 31 should possess an interior circumference in its unshrunk form which is equal to or preferably slightly greater than both the maximum outer circumference of cap 20, and the outer circumference of neck 12 of container 10 including protruding teeth 30. As illustrated in FIGS. 2 and 3, in the preferred embodiment neck 12 includes outward sloping shoulders 15 of increasing circumference.

When the interior circumference of shrinkable sleeve 31 is somewhat greater than the circumference of neck 12 at protruding teeth 30, sleeve 31 passes over the outward sloping teeth 30 and comes to rest on shoulders 15 with its bottom edge displaced a short distance below the lower edge of teeth 30. It is important that the shrinkable sleeve 31 be passed over teeth 30 to extend below the lower edge of teeth 30, so that the when the sleeve 31 is shrunk to provide a conforming fit to the bottle and neck as shown by shrunk sleeve 32 in FIG. 3, the plastic sleeve material extends around and below the pointed corners of teeth 30. Proper application of shrinkable sleeve 31 over teeth 30 is facilitated by the preferred downward slope of teeth 30, as illustrated in cross section in FIG. 3, which allows the sleeve to slide unencumbered over and past the teeth.

Shrinkable sleeve 31 further includes longitudinal areas of relative mechanical weakness, which in the preferred embodiment illustrated in FIG. 2 comprises two substantially parallel and closely spaced longitudinal rows of perforations 33 passing through the shrinkable plastic material of sleeve 31. These parallel perforations define a tear-away portion 36 of the shrinkable sleeve 31, which in the preferred embodiment further includes finger opening tab 34. Opening tab 34 provides means by which the purchaser may grasp tear-away portion 36 and, by applying force, overstress the narrow briding portions of the plastic material of sleeve 31 lying between perforations 33, thereby tearing the tear-away portion off of sleeve 31 and removing the sleeve from the container. In order to facilitate this operation, starting cuts 35 may be provided in the edge of shrinkable sleeve 31 proximate to pull tab 34, to provide localized areas of maximum stress to initiating the desired tear along perforations 33 when tab 34 is pulled.

Figure 7:
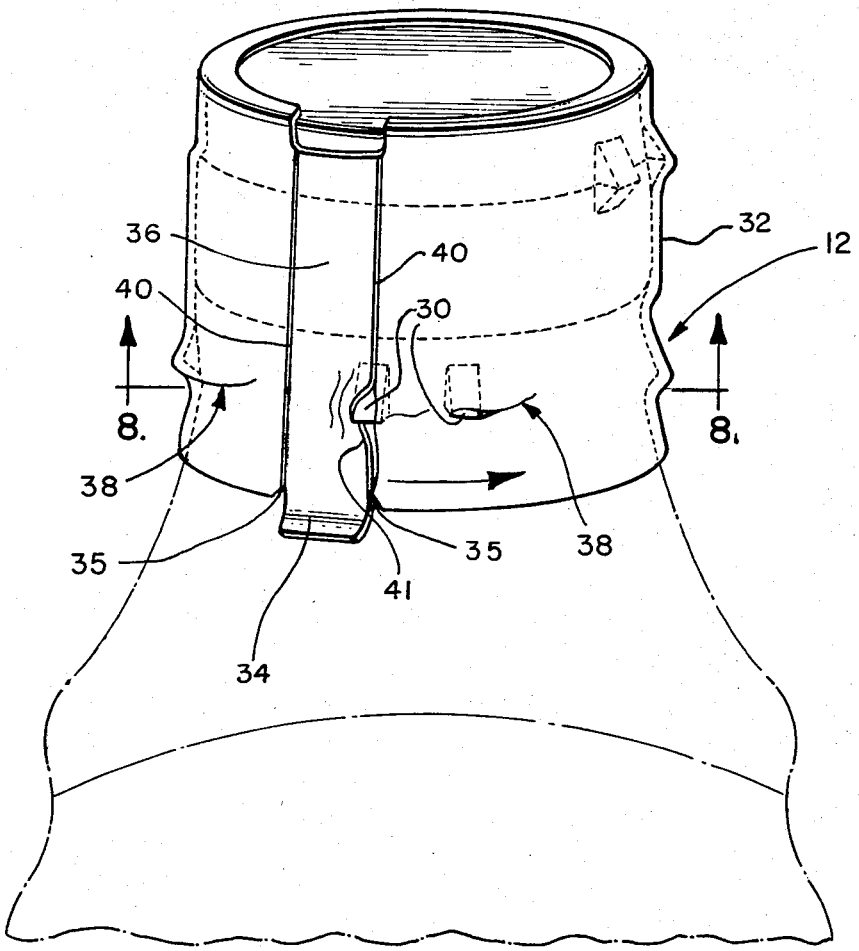
FIG. 7 is a perspective view of an embodiment of the tamper resistant closure system of the present invention with score lines.
Figure 8:
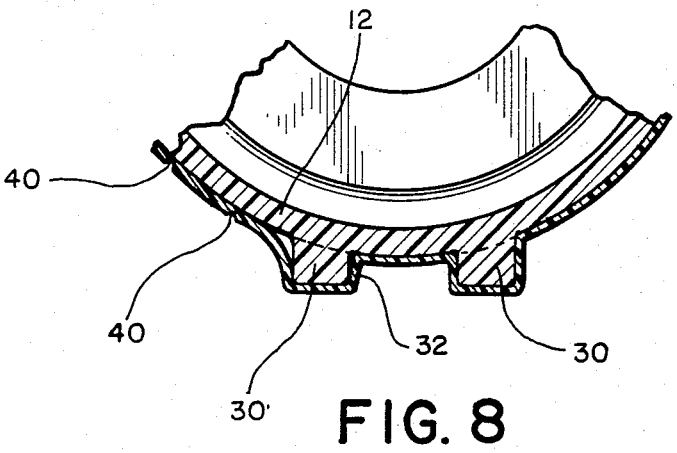
FIG. 8 is a partial sectional view taken along line 8—8 of FIG. 7, showing the reduced thickness at the score lines.

FIG. 7 illustrates another embodiment of the present invention wherein the longitudinal lines of relative mechanical weakness are provided by score lines 40 in sleeve 32. Specifically, as illustrated in FIG. 8, score lines 40 represent areas of reduced thickness of the plastic material comprising sleeve 32, in a manner known in the art. By providing two closely spaced and substantially parallel score lines 40 extending substantially across sleeve 32, a tear-away portion 36 of the sleeve is created. When force is applied to tab 34, the narrow regions of plastic material corresponding to score lines 40 will fail prior to the relatively thicker surrounding material, causing a desired tear to propagate along score lines 40 to detach the tear-away portion 36 and thereby remove the sleeve from the container.

Figure 4:
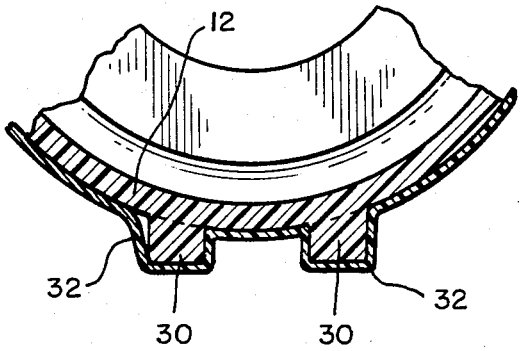
FIG. 4 is a partial sectional view taken along line 4—4 of FIG. 1.

Operation of the present invention may similarly be best understood with reference to the accompanying drawings. As illustrated in FIG. 1 and in cross section in FIG. 3, after the shrinkable sleeve 31 has been heated in a manner known in the art to reduced dimensions, providing a snug contoured fit over cap 20 and the portion of neck 12 including protruding teeth 30, the shrunk plastic sleeve 32 provides protective tamper resistant sealing. Specifically, the shrinkable plastic material will conform to the protruding teeth 30 of the container 10, as well as to the protruding features of cap 20, such as hinge 27 and finger tab 28, as illustrated in FIG. 4. Because of the inherent rigidity of the shrunk plastic material of shrunk sleeve 32, sleeve 32 provides a frictional mechanical linkage between cap 20 and teeth 30 of neck 12 which resists undesired or vibrational rotation of screwable cap 20.

Figure 6:
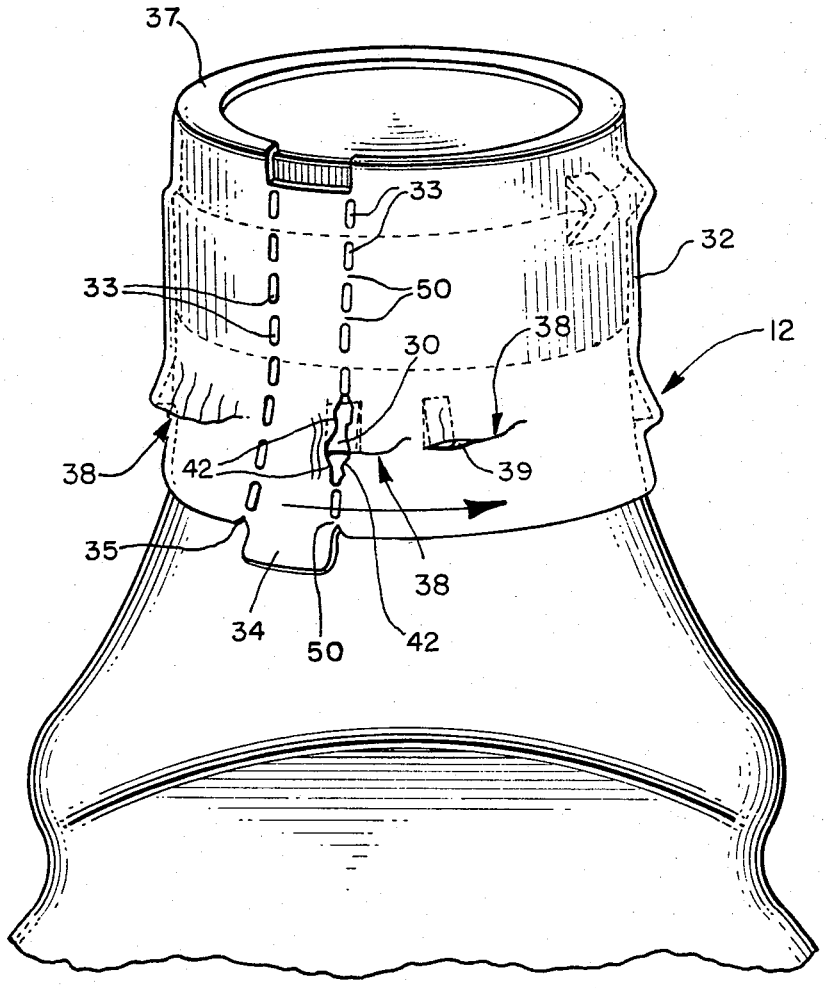
FIG. 6 is a perspective view of the embodiment of FIG. 1 with lines of perforations, illustrating the tamper evident features.

In addition, as shown in FIG. 6, the shrinkable sleeve may preferably extend slightly above cap 20 such that the shrunk sleeve 32 will overlap the top of cap 20 slightly. This overlap 37 prevents opening of the hinged flip-top 26 of the preferred embodiment illustrated, so that spout sealer 25 is securably maintained within pouring spout 24 throughout shipment and storage. Undesired tampering, such as removal of contents or adulteration of contents by addition of foreign substances, is prevented.

In addition to tamper resistance, the present invention primarily provides reliable and obvious indication of attempted tampering. As illustrated in FIG. 4 and as previously discussed, the shrunk plastic sleeve 32 will substantially conform to the outer contours of neck 12, including conforming to the protruding teeth 30. Once this shrinkable plastic material is shrunk to its conforming configuration, the material will retain this shape and configuration, as is known in the art, unless disturbed by external forces.

Figure 5:
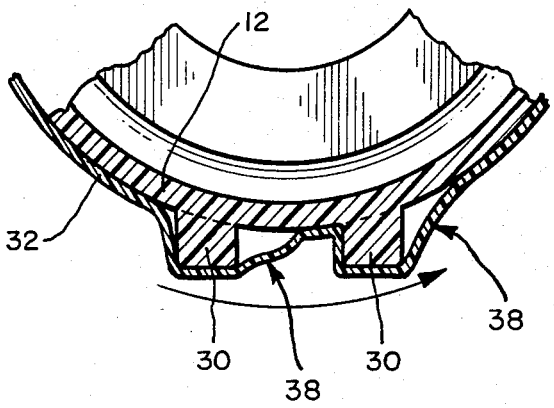
FIG. 5 depicts the view of FIG. 4 after the sleeve has been forcibly rotated relative to the container to illustrate one of the tamper evident features of the present invention.

If an attempt is made to tamper with the container 10 by rotating cap 20 to loosen or remove it, the shrunk plastic sleeve 32, cooperating with the protruding portions of cap 20 and driven by the rotational and gripping forces necessarily applied to cap 20, will likewise be made to rotate relative to the neck 12 of container 10. This rotation of sleeve 32 relative to neck 12 will cause the sleeve material to be forcibly passed over and across protruding teeth 30, as illustrated in FIG. 5. Portions of the material will therefore be forcibly stretched upon encountering protruding teeth 30 as shown in FIG. 5, resulting in disturbed portions 38 of shrunk sleeve 32. These disturbed portions 38 are further illustrated in FIG. 6, and are characterized by distended or stressed portions of shrunk sleeving 32. If the forces in the sleeve material caused by forcibly dragging the material across the sharp corners of teeth 30 exceed the strength of the material, rips 39 may also result.

Visible disturbed portions 38 and rips 39 therefore provide a first mechanism for disclosing to the purchaser the fact that a forced tampering has occurred. Because of the nature of the shrinkable plastic material utilized, these visual disturbances 38 and 39 will be substantially permanent and irreversible, providing reliable tamper indication.

The primary tamper indication provided by the present invention results from interaction between the longitudinal areas of relative mechanical weakness and the protruding teeth. Specifically, in the preferred embodiment shown in FIG. 6, the perforations in shrinkable sleeve 31 result in similar perforations 33 in the shrunk sleeving 32. These perforations are preferably arranged in two substantially parallel and closely spaced lines extending substantially across the sleeve 32, resulting in lines of mechanical weakness relative to the bulk of the sleeve 32. When an attempt is made to tamper with the container by rotating the cap and sleeve 32 relative to the neck 12 and the protruding teeth 30, one or more of the lines of perforations are brought into proximate contact with the sharp edges of the protruding teeth 30. The teeth 30 then engage one or more of the perforations 33 and resist further rotation of that portion of the sleeve immediately proximate to the engaged perforation, resulting in a localized stress in the plastic material comprising sleeve 32 and lying between the engaged perforations 33 and those adjacent. Such localized stress causes one or more of the linking areas 50 between perforations 33 to fail, or tear, as shown by torn links 42.

Alternatively or in addition to the foregoing, failure or tearing of the links 39 between perforations 33 may result from localized stresses created by the excessive stretching of the links 39 as the sleeve is forcibly rotated across the protruding teeth. In either instance, the sleeve material 32 is ruptured 42 between at least two of the perforations 33, providing an obvious and irreversible indication of tampering.

In the alternative embodiment of the present invention illustrated in FIG. 7 wherein the longitudinal areas of relative mechanical weakness are provided by score lines 40 of reduced thickness, interaction between the protruding teeth 30 and the mechanically weak score lines 40 similarly provides a primary indication of tampering. Specifically, when the thin portion of shrunk sleeve 32 corresponding to the score lines 40 is forcibly rotated and stretched across the sharp protruding tooth 30, a localized region of maximum stress is created which causes the mechanical failure of the thin sleeve material of score line 40. The resulting rupture or slit 41 along score line 40 provides the desired obvious and irreversible indication of tampering.

It is seen, therefore, that the present invention provides a tamper resistant closure for containers which simultaneously resists tampering, provides permanent and obvious indication of attempted tampering, while also providing a convenient method for removing the tamper resistant feature when desired.

It should be understood that, although the foregoing details preferred embodiments, other configurations are similarly possible. For example, although flip-top screwable cap 20 is illustrated and described, other forms of sealing caps known in the art may similarly be utilized, both with and without pour spout features. In addition, although the preferred embodiment for shrinkable sleeve 31 includes tear-away portion 36 and finger tab 34, other embodiments utilizing fewer or greater numbers of areas of mechanical weakness are similarly possible, both with and without finger tab 34. Finally, the specific number and arrangement of protruding teeth 30 in relation to neck 12 is subject to alternative embodiments. Although a preferred embodiment illustrated in FIG. 6 includes pairs of protruding teeth 30 on both the front and back of container 10, with single protruding teeth located on either side of neck 12, greater or fewer numbers of teeth may similarly be used. For example, FIG. 2 illustrates an embodiment wherein the side protruding teeth have been omitted, while FIG. 3 illustrates yet another embodiment utilizing four teeth spaced substantially equally around the periphery neck 12.

The foregoing description and drawings therefore merely explain and illustrate the invention. The invention is not limited thereto, except insofar as the appended claims are so limited, for those skilled in the art who have the disclosure before them will be able to make modifications and variations therein without departing from the spirit and scope of the present invention.

I claim:

1. A tamper resistant closure system, comprising:

a container having a neck and a mouth defining an opening, the mouth having threading for engaging a screwable cap;

at least one tooth projecting radially from said neck, said projecting tooth having a width which is narrow with respect to the circumference of said neck;

a screwable cap having threading for mating with the threading on the neck for capturing said cap in sealing relation to said mouth;

a shrinkable plastic sleeve having at least one area of relative mechanical weakness, said sleeve tightly shrunk to engage said cap and said neck, and said area of relative weakness positioned on said neck such that when said cap is twisted in an opening direction, said sleeve and said area of relative weakness will twist toward said at least one tooth and said at least one tooth will tear a portion of the sleeve proximate to said area of relative weakness to provide evidence of tampering.

2. The invention of claim 1 wherein the at least one tooth forms a substantially right triangle with said neck defining one leg and wherein the longest leg of said substantially right triangle extends from the neck to a second leg which extends substantially perpendicular from the neck.

3. The invention of claim 1 wherein said area of relative mechanical weakness comprises a series of closely spaced perforations.

4. The invention of claim 3 wherein said series of closely spaced perforations form a line of perforations.

5. The invention of claim 3 wherein said series of closely spaced perforations forms a longitudinal line of perforations.

6. The invention of claim 3 wherein said series of perforations forms two substantially parallel closely spaced lines of perforations.

7. The invention of claim 1 wherein said area of relative mechanical weakness comprises one or more score lines of reduced sleeve thickness.

8. The invention of claim 7 wherein said one or more score lines comprise two substantially parallel closely spaced score lines.

9. A tamper resistant closure system, which comprises:

a container having a hollow neck with a mouth at an upper end of the neck, the mouth defining an opening for filing and emptying the container;

a plurality of teeth spaced around the periphery of the neck, and extending radially therefrom such that the circumferential distance between said teeth is greater than the width of said teeth;

a thread on the mouth for engaging and capturing a mating thread on a cap;

a cap having a disc-shaped top portion and an annular skirt depending therefrom, said annular skirt including along an inside wall a thread for mating with the thread on said neck;

a sleeve of shrinkable plastic, said sleeve including at least one longitudinal line of relative mechanical weakness, said sleeve tightly shrunk around said cap and said neck to cover said annular skirt and said plurality of teeth, said line of relative weakness positioned such that when twisting forces are applied to the sleeve and the cap in an opening direction past at least one of the plurality of teeth, the tooth will tear the sleeve proximate to said line of relative weakness to provide evidence of tampering.

10. The invention of claim 9 wherein said plurality of teeth includes at least two pairs of closely spaced teeth.

11. The invention of claim 9 wherein the first pair of closely spaced teeth is located on one side of the container and the second pair of closely spaced teeth is located on an opposite side of the container.

12. The invention of claim 9 wherein said at least one longitudinal line of relative mechanical weakness comprises a series of closely spaced perforations.

13. The invention of claim 12 wherein said sleeve includes two approximately parallel lines of closely spaced perforations which define an opening tab to facilitate removal of the sleeve.

14. The invention of claim 12 wherein said cap further includes a pouring spout.

15. The invention of claim 9 wherein said sleeve further includes at least a first and a second longitudinal line of relative mechanical weakness substantially parallel and adjacent to one another, said sleeve also having an extended portion at one end of the sleeve between the two lines of relative weakness defining a tab, said two lines of relative weakness defining a tear-away portion to facilitate removal of the sleeve, and said tab providing a starting point for peeling said tear-away portion from said sleeve.

16. The invention of claim 15 wherein said first and second lines of relative mechanical weakness comprise lines of closely spaced perforations.

17. The invention of claim 15 wherein said first and second lines of relative mechanical weakness comprise score lines of reduced sleeve thickness.

18. The invention of claim 9 wherein said at least one longitudinal line of relative mechanical weakness comprises one or more score lines of reduced sleeve thickness.

19. A container for tamper resistant closure system, which comprises:

a hollow body for containing a substance;

a hollow neck extending upwardly from the body, the neck having at one end a generally cylindrical mouth defining a circular opening for introducing or emptying the substance to the hollow body of the container;

the neck including at least two pairs of teeth placed on opposite sides of the neck adjacent the mouth, each tooth having a substantially right triangular shape with the longest side of the triangle extending between a first point on the neck and a leg which extends substantially perpendicularly from the neck at a second point on the neck below said first point, said teeth for engaging a sleeve of shrinkable plastic having a pair of closely spaced, substantially parallel lines of longitudinal perforations and for severing said sleeve along at least one of said lines of longitudinal perforations when said sleeve is twisted;

said teeth having a width which is less than the circumferential distance between said at least two pairs of teeth.

20. A tamper resistant closure system, comprising:

a container having a hollow body, a hollow neck upwardly extending therefrom, the neck having a generally cylindrical mouth at an upper end thereof defining a substantially circular opening to introduce or remove a substance from the container;

a thread on the mouth for capturing a mating thread on a cap in closing relation;

a first pair of teeth positioned on the neck below the mouth on one side of the container, each tooth having a substantially right triangular shape with the longest side of the triangle extending between a first point on the neck and a leg which extends substantially perpendicularly from the neck at a second point on the neck below said first point;

a second pair of teeth positioned on the neck below the mouth on the opposite side of the container from said first pair of teeth, each tooth having a substantially right triangular shape with the longest side of the triangle extending between a second point on the opposite side of the neck and a leg which extends substantially perpendicular from the neck at a point below said second point;

said teeth having a width which is less than the circumferential distance between said first and second pairs of teeth;

a cap having a generally circular disc-shaped top portion and an annular shirt depending therefrom, said skirt including on an inner surface thereof a thread for mating with the thread on the mouth to capture the cap in sealing relation with the mouth;

a sleeve of heat shrinkable thermoplastic material, said sleeve having a pair of closely spaced, substantially parallel lines of perforations extending from end to end along a longitudinal axis of said sleeve, said lines of perforations defining a tear-away portion to facilitate removal of said sleeve and having an opening tab between said two lines of perforations to facilitate removal of the sleeve;

said sleeve tightly shrunk around the annular wall of the cap and the teeth on the neck of the container to grip said teeth and said annular wall, and positioned with the lines of perforations substantially adjacent said teeth such that when said cap and said sleeve are twisted in an opening direction, said lines of perforations move toward said teeth and said teeth tear said sleeve between at least two adjacent perforations in one of said lines to provide evidence of tampering.

* * * * *

UNITED STATES PATENT AND TRADEMARK OFFICE

CERTIFICATE OF CORRECTION

PATENT NO. : 4,538,740

DATED : Sep. 3, 1985

INVENTOR(S) : Petersen, Jr.

It is certified that error appears in the above-identified patent and that said Letters Patent is hereby corrected as shown below:

IN THE BACKGROUND OF THE INVENTION

In Column 1, line 46, please delete "systems" and insert "system";

IN THE DETAILED DESCRIPTION OF THE PREFERRED EMBODIMENT

In Column 4, line 2, please delete "disk-shaped" and insert "disc-shaped";

In Column 4, line 13, please delete "provide" and insert "provided";

In Column 4, line 45, please delete the word "the" before the word "when";

In Column 4, line 65, please delete "briding" and insert "bridging";

In Column 6, lines 39 and 41, please change the number "39" to "50";

In Column 8 of the Claims, line 11, please delete "filing" and insert "filling";

UNITED STATES PATENT AND TRADEMARK OFFICE

CERTIFICATE OF CORRECTION

PATENT NO. : 4,538,740

DATED : Sep. 3, 1985

INVENTOR(S) : Petersen, Jr.

It is certified that error appears in the above-identified patent and that said Letters Patent is hereby corrected as shown below:

IN THE DETAILED DESCRIPTION OF THE PREFERRED EMBODIMENT

In Column 10, line 16, please delete "shirt" and insert "skirt".

Signed and Sealed this

First Day of September, 1987

*Attest:*

*Attesting Officer*

DONALD J. QUIGG

*Commissioner of Patents and Trademarks*